US008007711B2

(12) United States Patent
Imiela et al.

(10) Patent No.: US 8,007,711 B2
(45) Date of Patent: Aug. 30, 2011

(54) METHOD FOR OPERATING A CONVERTER

(75) Inventors: Christian Imiela, Duesseldorf (DE); Stephan Schulze, Ratingen (DE); Stephan Six, Emdtebrueck (DE); Christoph Sundermann, Hilchenbach (DE); Joerg Hertel, Hilchenbach (DE); Rolf Best, Gladbeck (DE)

(73) Assignee: SMSDEMAG Aktiengesellschaft, Duesseldorf (DE)

( * ) Notice: Subject to any disclaimer, the term of this patent is extended or adjusted under 35 U.S.C. 154(b) by 256 days.

(21) Appl. No.: 12/443,733

(22) PCT Filed: Oct. 2, 2007

(86) PCT No.: PCT/EP2007/008543

§ 371 (c)(1),
(2), (4) Date: Jun. 15, 2009

(87) PCT Pub. No.: WO2008/040524

PCT Pub. Date: Apr. 10, 2008

(65) Prior Publication Data

US 2010/0084795 A1 Apr. 8, 2010

(30) Foreign Application Priority Data

Oct. 7, 2006 (DE) ..... 10 2006 047 555

(51) Int. Cl.
*C21C 5/50* (2006.01)

(52) U.S. Cl. ..... 266/44; 266/245; 266/247

(58) Field of Classification Search ..... 266/44, 266/245, 246, 247
See application file for complete search history.

(56) References Cited

U.S. PATENT DOCUMENTS

| | | | | |
|---|---|---|---|---|
| 3,207,002 | A * | 9/1965 | Lakin et al. | 266/246 |
| 3,364,773 | A | 1/1968 | Falk | 74/421 |
| 4,093,192 | A * | 6/1978 | Riegler et al. | 266/245 |
| 4,121,481 | A | 10/1978 | Riegler et al. | 74/410 |
| 4,265,136 | A | 5/1981 | Riegler et al. | 74/380 |
| 4,467,666 | A | 8/1984 | Ackermann | 74/411 |
| 5,003,835 | A | 4/1991 | Ackermann | 74/411 |
| 6,299,829 | B1 | 10/2001 | Chichery et al. | 266/245 |
| 2005/0012253 | A1 | 1/2005 | Wurm et al. | 266/243 |

OTHER PUBLICATIONS

Dr. Ing. Richard Ernst: "Woerterbuch der industriellen Technik", 2000 Brandstetter Verlag, Germany, Sentence 1252.

* cited by examiner

*Primary Examiner* — Scott Kastler
(74) *Attorney, Agent, or Firm* — Andrew Wilford

(57) ABSTRACT

In a method for operating a converter (1), in which the converter (1) is mounted in a carrying ring (3) by means of carrying journals (2), a gear mechanism (4) is mounted in a floating manner on the carrying journals (2), the converter (1) is configured, as a result, such that it can tilt about its horizontal axis and the gear mechanism (4) is connected rigidly to a pedestal (6) by a torque support (5), the torque support (5) connects the gear mechanism (4) to the pedestal (6) during the tilting operation of the converter (1), and the torque support (5) is released from the pedestal (6) or from the gear mechanism (4) or from both during operation of the converter (1).

4 Claims, 1 Drawing Sheet

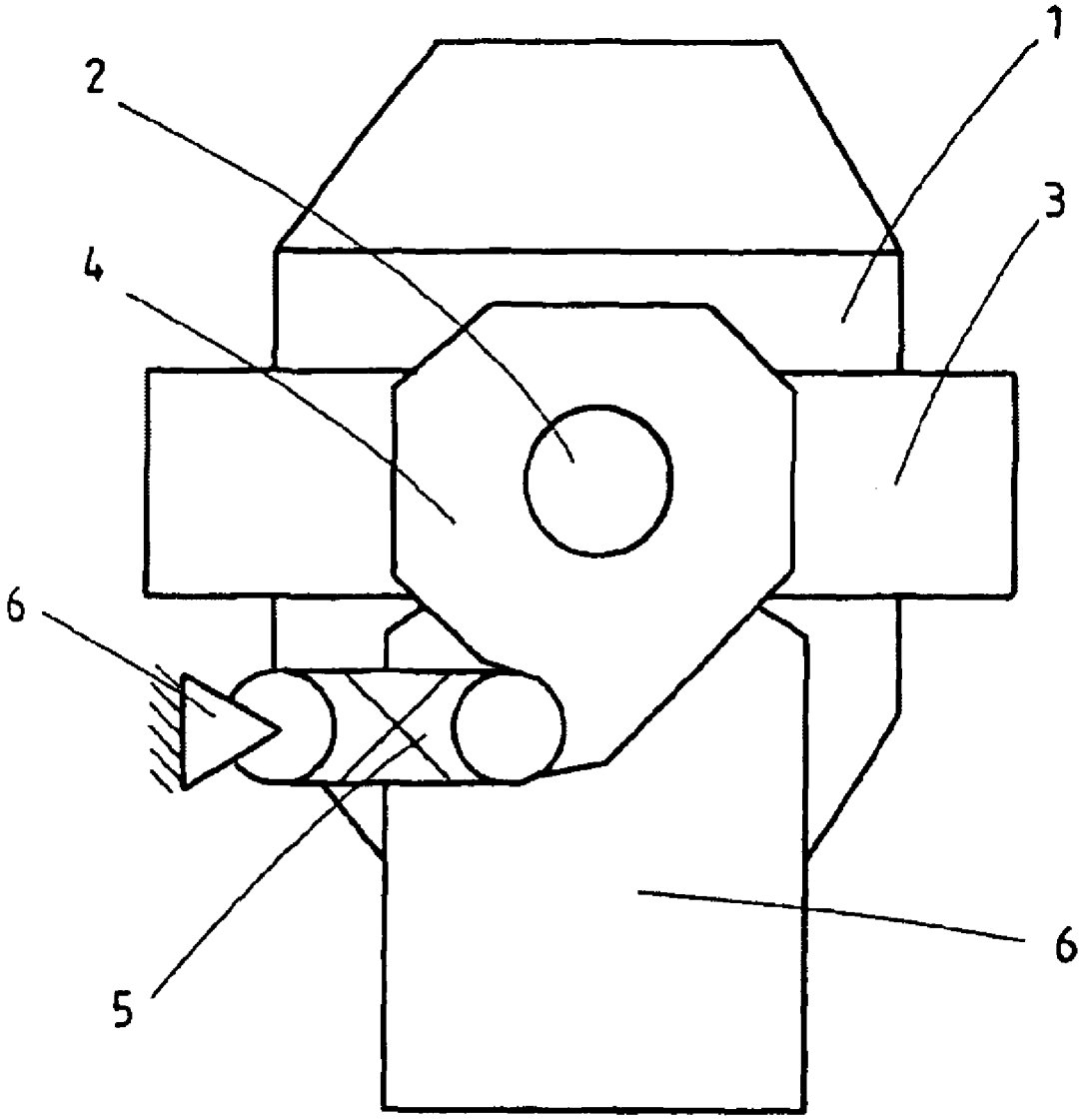
1
2
3
4
5
6
6

METHOD FOR OPERATING A CONVERTER

CROSS REFERENCE TO RELATED APPLICATIONS

This application is the US national stage of PCT application PCT/EP2007/008543, filed 2 Oct. 2007, published 10 Apr. 2008 as WO2008/040524, and claiming the priority of German patent application 102006047555.0 itself filed 7 Oct. 2006, whose entire disclosures are herewith incorporated by reference.

FIELD OF THE INVENTION

The invention relates to a method of operating a converter wherein the converter is mounted in a support ring by means of support trunnions and a drive is cantilevered off the support trunnions, the converter being therefore configured so as to tilt about its horizontal axis and the drive being rigidly connected with a base by means of a brace strut.

BACKGROUND OF THE INVENTION

In a converter, excess carbon is oxidized by introducing oxygen into the molten crude iron. The crude iron is thereby converted to steel.

DE 38 27 329 [U.S. Pat. No. 5,003,835] shows a torque-resisting strut for drives, particularly converter tilt drives, riding on the shaft trunnions, carrying the drive housing, and each flanged onto or screwed onto a step-down drive that engages with a pinion into a large gear mounted on the shaft trunnion so as to rotate with it, this mechanism consisting of strut rods attached symmetrically to the axis of rotation of the shaft trunnion to be driven to the drive housing by spherical bearings, the lower ends of the strut rods being respectively connected with pivots fixed on the floor and connected with one another by a rod. To this end the strut rods have in two parts; the free ends of the strut rods that are spaced from the pivots being connected with springs that function with tension and pressure, and the springs of the spring elements can be prestressed to a predetermined value by mechanical means.

WO 2003/023,072 [US 2005/0012253] shows a converter drive comprising a gear rim connected with the pivot trunnion of a converter vessel, in engagement with at least one drive pinion of the converter drive, and at least one locking device that can be pivoted into or out of the gears of the gear rim, in the form of a locking arm mounted on a horizontal shaft and formed with gear teeth. This converter drive is characterized in that the shaft of the locking arm is mounted in at least one bearing in the end position, and that the locking arms can be moved, with force fit, into the gear teeth of the gear rims by actuators, for example hydraulic cylinders, and can be moved out of engagement with the gear teeth and that the shaft of the locking arm is mounted in the housing of the converter drive at its shaft ends each with an eccentric bushing mounted to rotate freely in one another, in such a manner that a mutually ideal engagement position of the two interacting toothed regions of the locking device and of the gear rim can be adjusted by independent rotation of these bushings.

DE 26 54 907 [U.S. Pat. No. 4,121,481] shows a device on a converter having a tilt drive that is suspended on a tilt trunnion of the converter, and a strut that rests resiliently on the base. To this end, the tilt drive can be fixed in place relative to the base during the blowing process by a positioner.

EP 003 108 [U.S. Pat. No. 4,265,136] shows a strut for a drive that is mounted to move about a pivot axis, particularly for a converter drive, where the drive housing is supported, relative to the base, on both sides of the pivot axis with an elastic support device. In this connection, a cylinder to which compressed gas is applied is provided as the elastic support device; its position can be adjusted, relative to the base, by an adjustment device.

DE 30 07 916 [U.S. Pat. No. 4,467,666] shows a strut for a cantilevered drive, particularly for converter drives, the drive housing being mounted on its shaft trunnion that can be driven and carries a large gear, multiple step-down drives that drive the large gear being flanged onto the housing with their drive motors, in each instance, and first parallel levers spaced at equal intervals on opposite sides of the axis of rotation of the shaft trunnion being fixed to it by way of joints, which levers are connected with two identical parallel levers that are pivoted at a fixed location, with at least one coupler that connects the parallel levers, one of which extends at a slant and is provided with a spring, all the joints having ball joints. This strut is characterized in that the second parallel levers run at a slant in the normal position, that the coupler has at least two longitudinal segments each provided with a gap and that the coupler is articulated onto the joints that connect the two parallel levers.

A fixing member of an element of a kinematic chain, such as an element of a gear wheel translation, for example, is known from DE 600 04 714 [U.S. Pat. No. 6,299,829]. Such a fixing member is fixed to a base of a steel plant converter, for example.

It is therefore known that the converters are tilted for emptying by a cantilevered drive. In this connection, support of the turning moment is always done by a rigid brace strut, which is attached to a base on one end and on the drive on the other end. Converters having jets below the bath level are exposed to severe vibrations as the result of the moving steel bath during operation, i.e. when oxygen is fed in. This excitation takes place over a broad range in all directions, in other words also in the tilting direction. In order to relieve the stress of very great surges on the drive, the large gear is engaged by a locking arm that ensures that the surges are no longer applied by the large gear and the pinions, but rather are taken up by the strut, directly by way of the drive housing. In this connection, great forces act on the base of the casting platform and the brace strut, which leads to damage to the casting platform and other system parts.

OBJECT OF THE INVENTION

The object of the invention is to provide a method with which the above-described disadvantages are avoided.

SUMMARY OF THE INVENTION

This task is accomplished, according to the invention, in that the strut connects the drive with the base only during the tilting process, and is disconnected from the base or from the drive or from both of them during operation of the converter.

The decisive advantage of the method according to the invention lies in the fact that the converter can vibrate freely during operation when the brace strut is uncoupled. The amplitude of the free vibrations will remain restricted. By permitting free rotational movement, the forces introduced during operation are no longer transmitted to the base, but rather converted to movement energy. Stress on the base and the strut is relieved.

In a further development, in place of the brace strut, a shock absorber is employed. The converter vibrations are thus damped. The shock absorber that is coupled in is designed in such a manner that it limits the maximal amplitudes of the converter during operation, but without achieving the effect of a rigid strut.

BRIEF DESCRIPTION OF THE DRAWING

An illustrated embodiment of the invention will be described in greater detail using a very schematic drawing whose sole FIGURE shows, in a side view, a converter having a support trunnion in a support ring.

DETAILED DESCRIPTION

The single FIGURE shows a side view of a converter 1 having support trunnions 2. The support trunnions 2 fixed on opposite sides of the converter 1 are each seated in a support ring 3. In this way, tilting of the converter 1 about its horizontal axis is made possible.

A drive 4 for tilting the converter 1 is carried on an end of the support trunnion 2. The drive 4 is connected by a torque-transmitting brace strut 5 with a fixed base 6 in order to withstand the turning moment. The base 6 is the casting platform, for example. During tilting, the strut 5 connects the drive 4 on the base 6 in order to resist the turning moment.

During operation of the converter 1, i.e. while oxygen is introduced into the converter, the brace strut 5 is uncoupled either from the drive 4 or from the base 6 or from both of them, and the converter 1 can vibrate freely. Alternatively, a shock absorber can be installed parallel to the strut 5 during such operation, and the vibrations of the converter are damped by this shock absorber.

The invention claimed is:

1. A method of operating a converter wherein the converter is suspended by support trunnions and a drive extending from the support trunnions can tilt the converter about a horizontal axis, the drive being rigidly connectable with a base by a torque-transmitting strut, the method comprising the steps of:

connecting the drive by the strut with the base during tilting of the converter by the drive, and disconnecting the strut from the base, from the drive, or from both the base and the drive during operation of the converter.

2. The method according to claim 1 wherein during tilting the strut blocks rotation of the drive about the axis.

3. A method of operating a converter wherein the converter is suspended by support trunnions and a drive extending from the support trunnions can tilt the converter about a horizontal axis, the drive being rigidly connectable with a base by a torque-transmitting strut, the method comprising the steps of:

connecting the drive by the strut with the base during tilting of the converter by the drive, and disconnecting the strut from the base, from the drive, or from both the base and the drive during operation of the converter.

4. A method of operating a converter wherein the converter is suspended by support trunnions and a drive extending from the support trunnions can tilt the converter about a horizontal axis, the drive being rigidly connectable with a base by a torque-transmitting spring assembly, the method comprising the steps of:

connecting the drive by the spring assembly with the base during tilting of the converter by the drive, and disconnecting the spring assembly from the base, from the drive, or from both the base and the drive during operation of the converter.

* * * * *